United States Patent [19]

Bowman-Jones

[11] Patent Number: 4,639,612

[45] Date of Patent: Jan. 27, 1987

[54] ELECTRO MECHANICAL SWITCH HAVING REMOTELY CONTROLLED OFF POSITION

[75] Inventor: Gordon Bowman-Jones, Foster City, Calif.

[73] Assignee: Endless Energy, Inc., Paramas, N.J.

[21] Appl. No.: 729,924

[22] Filed: May 3, 1985

[51] Int. Cl.[4] ..... H01H 1/52

[52] U.S. Cl. ..... 307/132 E; 200/291; 307/114; 335/15; 335/21

[58] Field of Search ..... 200/291; 307/132 E, 307/132 R, 114, 115; 361/92, 187, 160, 194; 335/2, 15, 16, 21, 22, 171

[56] References Cited

U.S. PATENT DOCUMENTS

| | | | |
|---|---|---|---|
| 3,256,407 | 6/1966 | Klein | 361/92 X |
| 3,684,850 | 8/1972 | Kaderbek et al. | 200/291 |
| 3,860,910 | 1/1975 | Hudson | 307/114 X |
| 4,466,040 | 8/1984 | Barthel et al. | 361/92 |

FOREIGN PATENT DOCUMENTS

| | | | |
|---|---|---|---|
| 1152468 | 8/1963 | Fed. Rep. of Germany | 335/21 |
| 2498807 | 7/1982 | France | 307/115 |
| 54-144071 | 11/1979 | Japan | 307/115 |

*Primary Examiner*—William M. Shoop, Jr.
*Assistant Examiner*—Bentsu Ro
*Attorney, Agent, or Firm*—Flehr, Hohbach, Test, Albritton & Herbert

[57] ABSTRACT

An electromechanical switch can be remotely opened by the interruption of electrical power to the switch for a minimum period of time. The switch includes a power terminal, a first switch (off) terminal, and a second switch (on) terminal. A first spring contact is coupled to the power terminal and spring biased to the off switch terminal. A second spring contact is coupled to the on switch terminal and is configured to receive the first spring contact in yieldable engagement. A lever is coupled to the first spring contact for manually moving the first spring contact to engagement with the first spring terminal and with the second spring contact. A solenoid is actuated in response to the interruption of power from the switch and flexes the second spring contact for releasing the yieldable engagement of the first and second spring contacts.

6 Claims, 3 Drawing Figures

ELECTRO MECHANICAL SWITCH HAVING REMOTELY CONTROLLED OFF POSITION

This invention relates generally to switch apparatus for electrical loads, and more particularly the invention relates to an electro mechanical switch which can be remotely turned off.

In large buildings having many light circuits, for example, it is desirable to control the lights remotely from a central control center. This has been accomplished before by applying additional interconnecting wires or superimposing a carrier signal on the power line for transmitting control signals to special switches in the lighting environment.

Switches are known which can be turned on or off remotely by selectively interruption of power. However, such switches are relatively complex and expensive.

The present invention is directed to remotely controlling only the off position of a switch by momentary interruption of power to the switch circuit. Thus, lighting loads in an office building, for example, can be turned off from a central control station in order to conserve energy consumption. Power can thereafter be returned to the switch circuit, and the lighting load can be reenergized manually by a user at the location.

Accordingly, an object of the invention is an efficient method of remotely controlling power consumption in a multiload environment such as an office building.

Another object of the invention is an economical electro mechanical switch which responds to momentary power interruption by assuming an off position.

The invention and objects and features thereof will be more readily apparent from the following detailed description and appended claims when taken with the drawing, in which:

Figure 1:
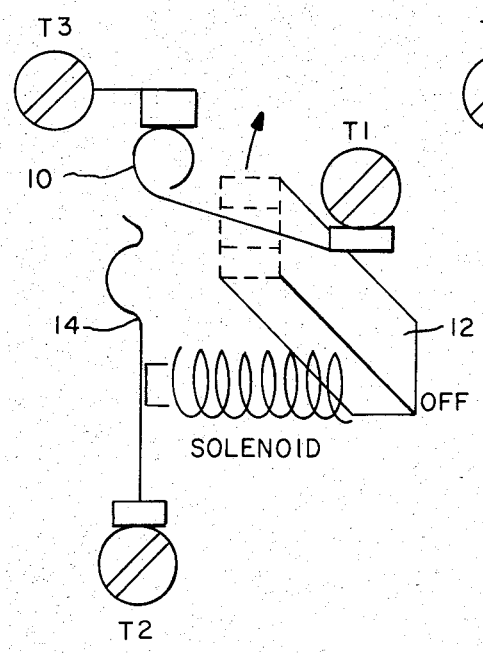
FIG. 1 is a schematic representation of one embodiment of a switch in accordance with the present invention in an OFF position.
Figure 2:
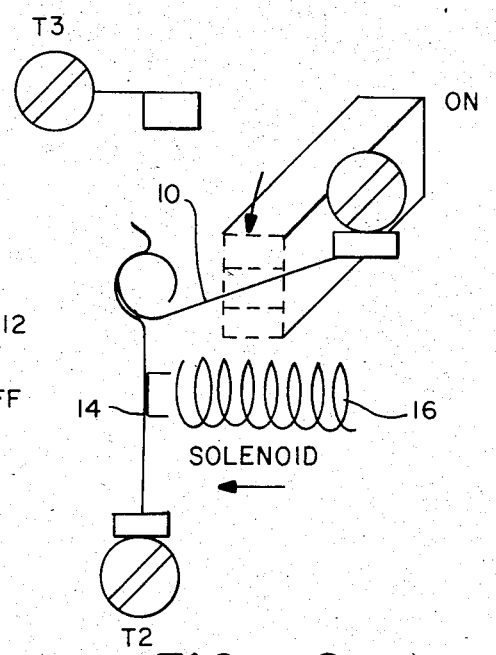
FIG. 2 is a schematic representation of the switch of FIG. 1 in an on position.

Referring now to the drawings, FIG. 1 is a schematic representation of one embodiment of a switch in accordance with the present invention. The switch controls power from the incoming power terminal T1 to a second electrical terminal T2 (ON position) or to a third terminal T3 (OFF position). A spring contact 10 connected to terminal T1 is biased upwardly to OFF terminal T3 and can be manually moved to the ON position by means of a conventional toggle lever 12. When the toggle lever 12 is moved to the ON position, as shown in FIG. 2, lever 12 engages a cam surface of a spring contact 14 which is electrically connected to the terminal T2. The contact 14 is spring biased to maintain engagement with contact 10, the mating cam surface of lever 14 conforming to the enlarged end of spring contact 10.

The switch can be returned to the OFF position manually by moving the toggle lever 12 or, in accordance with the invention, a solenoid 16 is momentarily energized with a piston moving the spring contact 14 out of engagement with the spring contact 10 whereupon the biased spring contact 10 moves upwardly in contact with terminal T3 in an OFF position.

Figure 3:
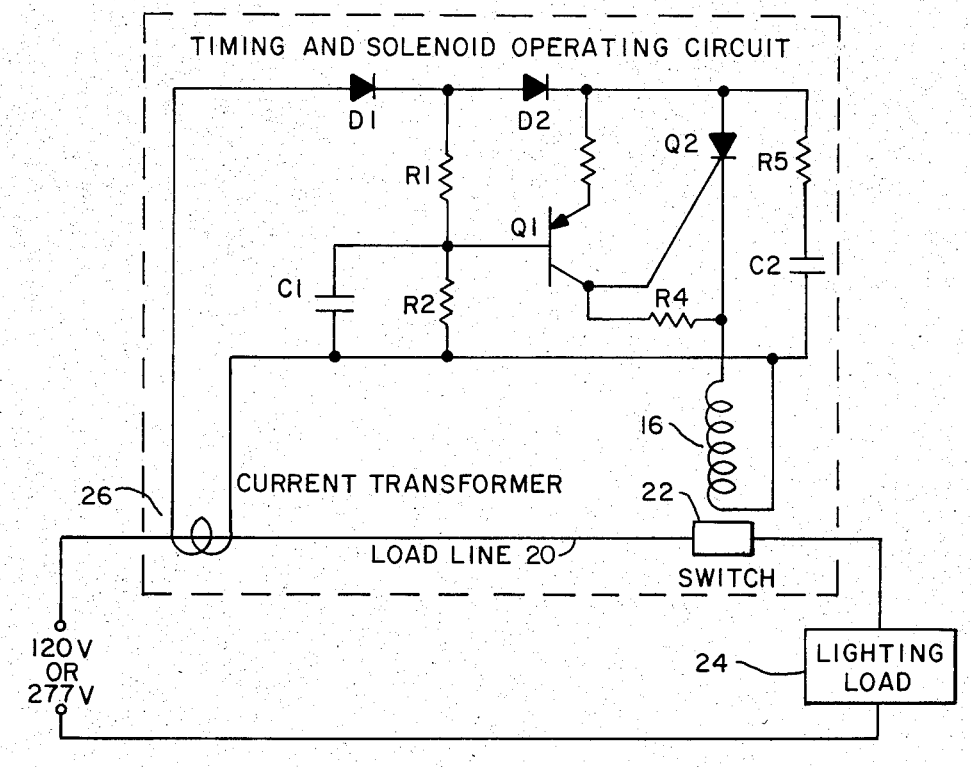
FIG. 3 is an electrical schematic of circuitry responding to power interruption for turning the switch of FIG. 1 to an OFF position.

Actuation of solenoid 16 is controlled by the electrical circuit shown in FIG. 3. Power from a 120 volt or 277 volt line is applied through a load line 20 and the switch shown generally at 22 to lighting load 24. Coupled to the load line 20 is a current transformer 26 which charges capacitors C1 and C2 through two serially connected diodes D1 and D2 and resistors R1 and R5. Capacitor C1 is serially connected with resistor R1 and in parallel with resistor R2, and capacitor C2 is connected serially with resistor R5.

When electrical power is removed from the load line 20 for a minimum period of time of three seconds, for example, the charge on capacitor C1 discharges through the base of transistor Q1 which is serially connected with resistors R3 and R4 across a silicon controlled rectifier (SCR) Q2. When C1 is discharged, Q1 turns on into the gate of SCR Q2 thus firing the SCR. Q2 then conducts the charge on capacitor C2 through resistor R5 into the coil of solenoid 16. The solenoid piston drives forward in the direction indicated in FIG. 2, moving the spring contact 14 and releasing the spring contact 10 thereby opening the circuit. A neon indicator can be provided inside the switch which becomes illuminated across the open contact thereby indicating that power is available to the switch. The switch can now be turned on manually to restore power to the load, if desired.

An electromechanical switch in accordance with the invention is efficient in operation and economical to install. While the switch has been described with reference to a specific embodiment, the description is illustrative of the invention and is not to be construed as limiting the invention. For example, the lever and spring contact could be replaced by a spring biased sliding bar which engages fixed contacts and is latched by the solenoid. Thus, various modifications and applications may occur to those skilled in the art without departing from the true spirit and scope of the invention as defined by the appended claims.

What is claimed is:

1. An electromechanical switch comprising a power terminal for receiving electrical power, a first switch terminal, a second switch terminal, a first spring contact coupled to said power terminal and spring biased towards said first switch terminal, a second spring contact coupled to said second switch terminal and configured to receive said first spring contact in yieldable engagement, a lever coupled to said first spring contact for manually moving said first spring contact to engagement with said second spring contact, and solenoid means actuable in response to removal of power from said switch for releasing the yieldable engagement of said first and second spring contacts.

2. The electromechanical switch as defined by claim 1 wherein said solenoid means includes a solenoid having a coil and piston, capacitive means for storing an electrical charge, current transformer means coupled to a power line for charging said capacitive means when said electromechanical switch is closed, and switch means responsive to removal of power for discharging said capacitive means through said solenoid and thereby actuating said solenoid means.

3. The electromechanical switch as defined by claim 2 wherein said switch means includes a silicon controlled rectifier and means for firing said silicon controlled rectifier upon removal of power for a minimum period of time.

4. The electromechanical switch as defined by claim 3 wherein said first spring contact includes an enlarged end portion and said second spring contact is configured to receive said enlarged end portion and maintain engagement of said first and second spring contacts, said solenoid means flexing said second spring contact for releasing the yieldable engagement of said first and second spring contacts.

5. The electromechanical switch as defined by claim 1 wherein said first spring contact includes an enlarged end portion and said second spring contact is configured to receive said enlarged end portion and maintain engagement of said first and second spring contacts, said solenoid means flexing said second spring contact for releasing the yieldable engagement of said first and second spring contacts.

6. An electromechanical switch comprising a power terminal for receiving electrical power, a first switch terminal, a second switch terminal, a first spring contact coupled to said power terminal and spring biased towards said first switch terminal, a lever means coupled to said first spring contact for manually moving said first spring contact to engagement with said second switch terminal, and solenoid means actuable in response to removal of power from said switch for releasing said first spring contact from said second switch terminal, said solenoid means including a solenoid having a coil and piston, capacitive means for storing an electrical charge, current transformer means coupled to a power line for charging said capacitive means when said electronmechanical switch is closed, and switch means responsive to removal of power for discharging said capacitive means through said solenoid and thereby actuating said solenoid means.

* * * * *